United States Patent [19]

Gore et al.

[11] 4,043,483

[45] Aug. 23, 1977

[54] DRAWER APPARATUS FOR ARTICLE DISPENSING MACHINE

[75] Inventors: LeRoy D. Gore, Independence, Mo.; William G. Gillett, Kansas City, Kans.; George F. Roberts, Independence, Mo.

[73] Assignee: The Vendo Company, Overland Park, Kans.

[21] Appl. No.: 720,908

[22] Filed: Sept. 7, 1976

[51] Int. Cl.[2] ..... A47F 1/12

[52] U.S. Cl. ..... 221/155; 221/198; 221/232

[58] Field of Search ..... 221/198, 155, 232, 273, 221/274, 279, 281; 312/35, 323, 330

[56] References Cited

U.S. PATENT DOCUMENTS

| | | | |
|---|---|---|---|
| 461,375 | 10/1891 | Spavnhorst | 312/330 |
| 1,901,243 | 3/1933 | Horwitt | 221/281 X |
| 2,098,697 | 11/1937 | Vanderput | 221/274 X |
| 2,330,806 | 10/1943 | Benjamin | 221/198 |
| 3,115,991 | 12/1963 | Carew et al. | 221/198 |
| 3,344,953 | 10/1967 | Krakaugr | 221/155 X |
| 3,377,115 | 4/1968 | Hansen et al. | 312/330 |
| 3,831,807 | 8/1974 | Deaton et al. | 312/323 X |

*Primary Examiner*—Robert B. Reeves
*Assistant Examiner*—Fred A. Silverberg
*Attorney, Agent, or Firm*—Schmidt, Johnson, Hovey & Williams

[57] ABSTRACT

An improved dispensing drawer is provided for article dispensing machines, especially those of the so-called "helix vendor" type, which is slideably removable from the front of the dispensing machine and includes at least one article receiving cartridge removably secured within the drawer for efficient loading, storage and release of articles to be dispensed therefrom. The cartridge is removable and replaceable after being loaded with articles from the front of the machine and does not require removal of the drawer for access thereto. An opening in the rear end of the cartridge permits rapid carton-like loading of articles therein when removed from the drawer for replenishment of the dispensing machine by a serviceman. A swingable, article engaging element mounted in the front of the drawer adjacent a pair of opposed lateral openings in the front end of the cartridge is actuated through a coupling forming a part of the drawer assembly by a power drive provided in the machine and operably coupleable with the drawer at the rear of the latter. When actuated, such element swings through one opposed opening in the cartridge adjacent its front extremity to contact an article and force the same through an opposed second opening, thereby dispensing the article.

8 Claims, 8 Drawing Figures

DRAWER APPARATUS FOR ARTICLE DISPENSING MACHINE

This invention relates to improved drawer apparatus for article dispensing machine of the type capable of dispensing a variety of products and which allow a customer to view a selected product prior to dispensing thereof. The invention significantly employs article receiving cartridge means, which are readily removable from and replaceable in the machine without removal of the drawer to allow quick and efficient restocking of articles in the machine on a first-in, first-out basis for automatic stock rotation.

A large number of products vended from coin operated dispensing machines are of the so-called "bag-pack" type, such as candies, potato chips and the like. One means for efficiently dispensing a variety of such products is disclosed in U.S. Pat. No. 3,653,540 to Elmer Bradley Offutt, issued Apr. 4, 1972, wherein the articles are loaded in and dispensed from removable drawers employing a pair of spaced apart, parallel helices which are rotated in opposite directions to move vend items disposed within convolutions thereof forwardly off the edge of the drawer for discharge to a customer. In such machines, the drawers are shiftably or removably mounted to allow a serviceman access to the helix storage means, but in stocking such machines the serviceman must first pull the drawer out and then carefully place each item, one by one, within an opposed pair of convolutions of the helices. This dispensing approach is particularly suitable for irregularly shaped bag-pack items, but is rather inefficient for use with so-called "flat-pack items" such as gum, mints and the like. Also, drawers employing a helix type dispensing mechanism necessarily provide a certain amount of unusable spacing between the stored articles, whereas flat-pack products are most efficiently stored in abutment to each other in a dispensing machine, and, in fact, such items are normally packaged by the manufacturer in such manner as to be most easily transferable by a serviceman to a dispensing machine in multiple quantities.

This invention eliminates the aforementioned inefficiencies of dispensing drawers employing helix type dispensing mechanisms for the handling of flat-pack type articles by providing a particularly simple, yet reliable, improved drawer construction for use in the mentioned class of machines. In our preferred embodiment, each drawer receives a pair of removable cartridge means which are releasably secured within the drawer. Each cartridge means is of suitable cross-section configuration to receive a quantity of a particular kind of articles in abutting, aligned relationship therein. One end of each cartridge is open to permit rapid restocking of products therethrough by a serviceman, while the opposite end has a first opening to clear a shiftable, drawer mounted, article engaging element that, when actuated, swings through the first opening to engage an adjacent end-most article and force the same through an opposed second opening in the cartridge, thereby dispensing such article. The article engaging element is operably coupled through shiftable means incorporated in the drawer with drive means provided in the machine in which the drawer is received. Each cartridge means may be quickly removed from its drawer at the front of the machine for replenishment or for replacement with a cartridge means that has been pre-loaded, without removing the associated drawer.

A primary object of the invention is to provide a unique means for dispensing flat-pack type products such as gum, mints, cigarettes and the like from an article dispensing machine.

Another object of the invention is to provide a novel dispensing means of the character described, which includes a cartridge-like means for storing a quantity of such products in side-to-side abutment, thereby increasing storage and vending capacity.

A further object of the invention is to provide a cartrdige-like dispensing means which may be readily removed from the front of the dispensing machine by a serviceman and rapidly restocked in stack or carton-like fashion for efficient replenishment of the machine.

A still further object of the invention is to provide an improved dispensing drawer of the character described, which is insertable in, and compatible with, existing dispensing machines of the general class adapted to employ drawer-like dispensing means.

Another object of the invention is to provide cartridge dispensing means, which are removably secured within a sliding drawer-type dispensing machine, so as to be readily removable therefrom and replaceable therein without removal of the drawer means from the dispensing machine.

A further object of the invention is to provide cartridge-like dispensing devices of the character described, which are adapted to be conditioned to dispense products therefrom by drive means external to the said drawers in which the cartridges are mounted.

A still further object of the invention is to provide a unique coupling and actuating mechanism carried by a dispensing drawer for causing the dispensing of a product from a removable, article storing cartridge receivable in the drawer.

Another object of the invention is to provide a drawer-like dispensing means suitable for receiving a pair of the cartridge-like dispensing devices to allow vending of either two different products or a double quantity of the same product from the same drawer, with products being dispensed alternatively from each of such cartridges.

Figure 1:
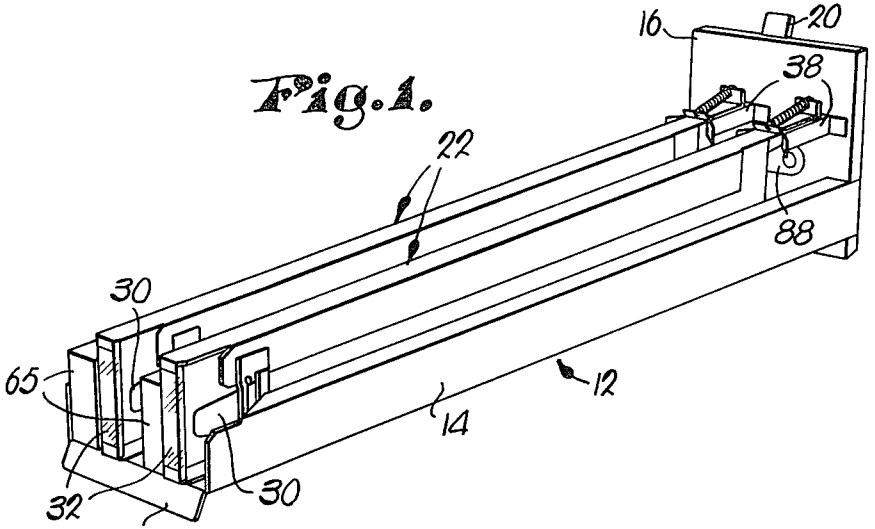
FIG. 1 is a perspective view of a dispensing drawer removed from a dispensing machine and including a pair of cartridge means releasably secured therein which comprise a preferred form of the invention.

Referring now to FIGS. 1, 2, 3, 6 and 8, a dispensing drawer broadly designated by the numeral 12 has a pair of elongated and vertically projecting sides, one of same indicated by the numeral 14 in FIG. 1 and includes a rear wall 16 extending somewhat above said sides and below the supporting bottom 18. Rear wall 16 has an upstanding tab 20 centrally secured on the upper horizontal edge thereof and also has a notch 19 formed in the central portion of the lower horizontal edge, both said notch and tab being received by guideways in the dispensing machine (not shown) for slideably inserting and removing the drawer 12 from the same. The dispensing drawer 12 forms a shelf means for mounting a number of components thereon, the front of the same facing the front of the dispensing machine when inserted therein and being open to slidably receive a pair of cartridge means, each of the latter indicated by the numeral 22. The front portion of the supporting bottom 28 has secured thereto a lip 24 which provides a means of griping the drawer 12 for removal of the latter from the dispensing machine and further provides a surface, viewable from the front of the machine, for labelling the articles to be dispensed.

Cartridge means 22 extend longitudinally, essentially the entire length of the drawer 12 and are of suitable cross-section configuration to receive a plurality of flap-pack type articles therein, in aligned, successively abutting arrangement, the particular cartridges shown in the present embodiment being suitable for receiving packages of gum or the like. Cartridge means 22 are manufactured as by metal forming with the longitudinal sides thereof forming an enclosure for the articles, while one of said sides vertically disposed has a slot-like opening 26 formed therein, extending essentially the entire length of the cartridge means to receive later discussed means for urging articles toward the front extremity thereof. Thus, each of the cartridge means 22 provide a means of storing product within the machine which is particularly simple in structure since an essentially one-piece enclosure is utilized. The rear end of cartridge means 22 is likewise open to receive the means for urging the articles, while one vertical side wall is cut away near the rear of the cartridge means (best seen in FIG. 2) to allow rapid stack or magazine-like loading of articles into the same by a serviceman when such cartridge means is removed from the drawer 12. The forward or "front facing" end of the cartridge means have opposed lateral openings in the vertical side walls thereof, one of same configured to allow a single article to be dispensed therethrough, the second opening being of an appropriate shape to receive an article engaging element therethrough, to be discussed infra. A resilient tab-like retaining element 30, suitable mounted on the vertical side wall containing the first aforementioned lateral opening and adjacent to the latter, projects sufficiently over said opening to prevent articles from being dispensed therethrough except on those occasions when a later discussed article engaging element impels an article through said opening into contact with said retaining element whereupon the latter is responsive to deflect away from the opening and allow the article to exit therefrom. A transparent window 32 made of plastic or the like is secured in the forward end of the cartridge means 22, adjacent the opposed lateral openings, to allow viewing by a user of the forwardmost article within the cartridge means 22, prior to dispensing of the same. A tab-like detent element 34 depends from the bottom side of the cartridge means 22 near the front portion thereof and extends downwardly and forwardly to engage a complimenting slot means formed in the supporting bottom 18 of the dispensing drawer 12.

Cartridge means 22 are inserted into dispensing drawer 12 by sliding the same into the open front end of said drawer and are removably secured therein by laterally supporting structure and releasable holding means which will be presently discussed.

Generally U-shaped, guideways 36 are rigidly secured on the supporting bottom 18 and are disposed essentially parallel to the elongated sides of the drawer 12. Guideways 36 are of appropriate size to slideably receive the bottom side of cartridge means 22 thereon and function to guide the same during insertion thereof whereby an upper, rearward portion of said cartridge means is aligned to be received by upper guides 38 which are fixedly secured as by welding to the rear wall 16 of the drawer 12.

Figures 5, 6, 7, 8:
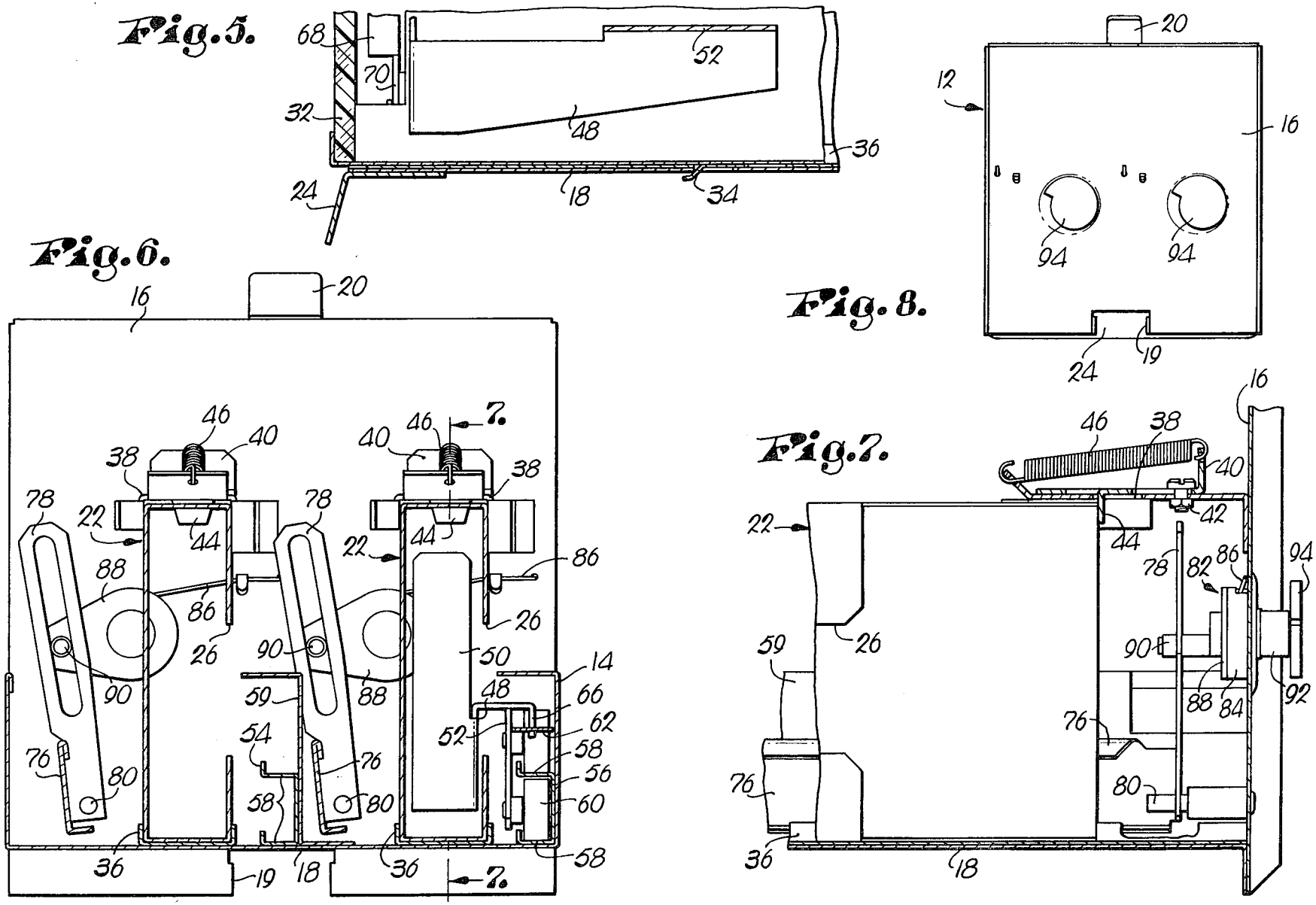
FIG. 5 is a fragmentary, vertical cross-sectional view taken along the line 5—5 of FIG. 3 to better illustrate the positioning of a pushing arm within a cartridge means and showing the pushing arm in its forwardmost position within the cartridge means when the latter is empty of product.
FIG. 6 is a cross-sectional, front elevational view of the dispensing drawer including a single cartridge means releasably engaged in one side thereof, and showing a spring loading assembly for one cartridge means position, said assembly being removed from the other cartridge means position to better depict the structural guideways used for mounting such assembly.
FIG. 7 is a fragmentary vertical cross-sectioned said elevational view, taken along the line 7—7 of FIG. 6, showing the rearwardmost portion of the dispensing drawer having a cartridge means therein, and illustrating a portion of the drive mechanism for dispensing articles stocked with said cartridge means.
FIG. 8 is a rear elevational view of the dispensing drawer, taken on a smaller scale, showing cam-like disc components which form a portion of the drive mechanism for the preferred form of the invention.

Referring now also to FIG. 7, the loading element 40 is movable secured to the top side of the upper guide by screw and nut combination 42 which passes through a forward running slot formed in said loading element to allow forward sliding movement of the latter. The loading element 40 includes a cartridge engaging appendage 44 which projects perpendicularly downward through a matching slot formed in upper guides 38, said element further having a vertically upward projecting flange on the rearward end thereof. A spring 46 has one end thereof suitably fastened to a forward flanged portion of upper guide 38 with the other end of said spring being secured to said rear flange of loading element 40 to bias the latter forwardly whereby cartridge engaging appendage 44 slides forwardly under the force of the spring 46, to contact and forwardly load the cartridge means 22. In order to insert the cartridge means 22 into the drawer 12, the former is easily slided rearwardly in its guideway 36 until the same is engaged by the appendage 44, whereupon, with additional rearward force being applied to said cartridge means, the loading element likewise slides rearwardly against the biasing force of spring 46 until the priorly mentioned detent element 34 is placed in communication with the corresponding slot means which extends through the guideway 36 and the supporting bottom 18 of drawer 12. When such communication takes place, the detent element 34 drops into its associated slot, preventing subsequent forward movement of the cartridge means 22 under the biasing influence of the spring 46 and thereby securing the same in place within the drawer 12 until such time as it is desired to remove said cartridge means for servicing, restocking or the like. To effect removal of the cartridge means 22 from the drawer 12 said cartridge means is first displaced rearwardly a slight distance to allow the detent element 34 to vertically clear the associated slot, and is then lifted vertically a sufficient distance to remove said detent element from the slot, and finally may be then removed by pulling the same forwardly out of the front of the drawer 12. From the foregoing then, it is clear that the cartridge means 22 may be quickly and easily inserted in, or removed from, a dispensing drawer in essentially a "one-hand operation" by a serviceman for replenishment of the machine.

Figure 4:
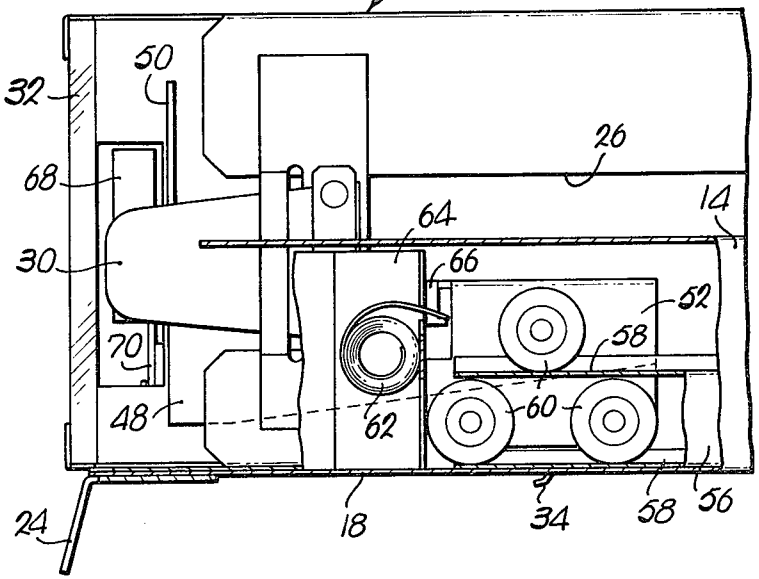
FIG. 4 is a fragmentary, cross-sectional side elevational view of the dispensing drawer, showing the forward portions of the cartridge means in a normal position of engagement with said dispensing drawer, parts being broken away to better show a spring loading assembly for urging articles forwardly through said cartridge means.
Figure 2:
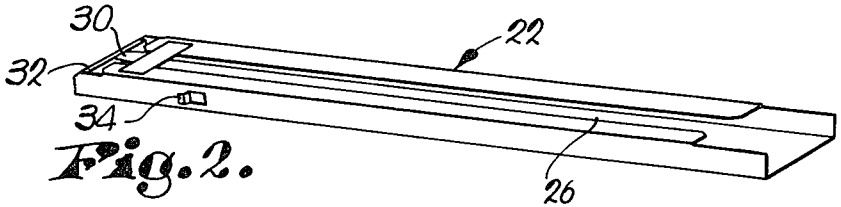
FIG. 2 is a perspective view of a single cartridge means, empty of product and removed from the associated dispensing drawer as during restocking of the same with vend articles by a serviceman.
Figure 3:
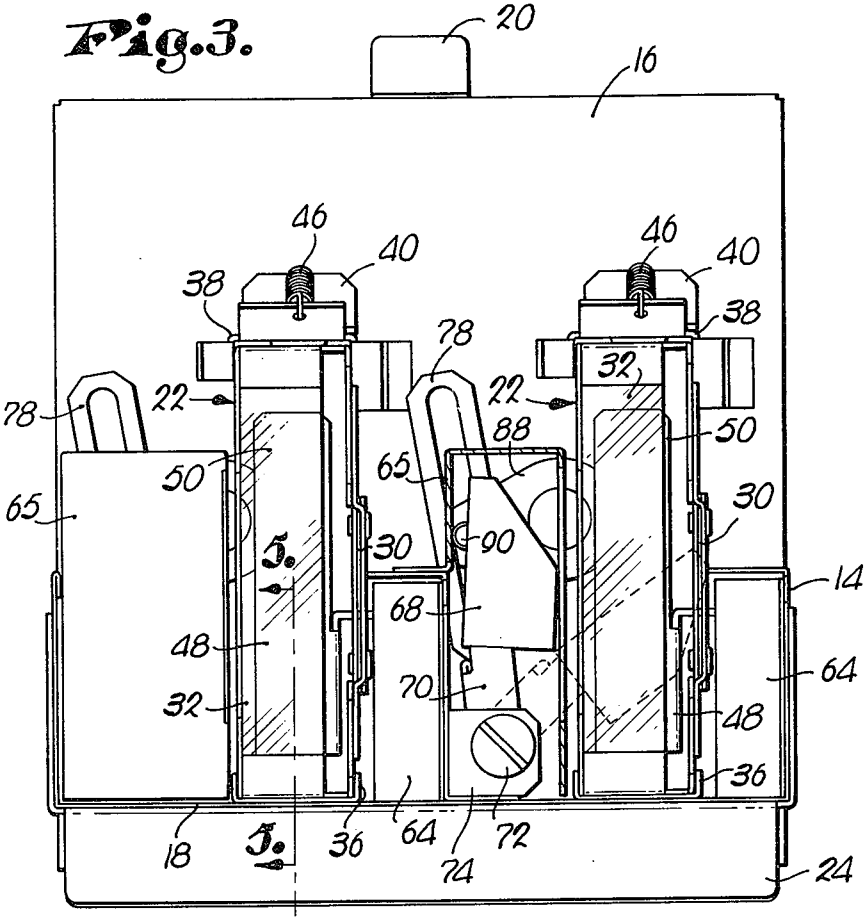
FIG. 3 is a front elevational view of the dispensing drawer of FIG. 1 taken in larger scale, portions being broken away for clarity and showing an article engaging element in a standby position as represented by solid lines and in an operated position represented by broken lines.

Referring also now to FIGS. 4 and 5, with the cartridge means 22 loaded with articles and inserted in the drawer 12, a means for urging said articles therein toward the front of the cartridge means is provided by pushing arm 48. Pushing arm 48 is manufactured as by metal forming and, as best seen in FIGS. 3 and 6, the forward end of the arm 48 terminates in a vertically extending, front-facing surface 50 which is disposed within the cartridge means 22 and engages a substantial surface area of the last, or rearwardmost article to be dispensed within said cartrdige means. The arm 48 projects longitudinally toward the rear of the drawer 12 and has formed on the rearward portion thereof a U-shaped flange 52 which extends laterally through the above-mentioned slot-like opening 26 in cartridge means 22 and turns vertically downward on the outer end thereof. A pair of double-tiered guideway structures 54 and 56 are secured to the supporting bottom 18, proximal to the outermost vertical side of the flanges 52, and extend longitudinally essentially the full length of the drawer 12, parallel to the cartridge means 22. As shown in FIG. 6 guideway structure 56 employs a side 14 of the dispensing drawer 12 as a supporting member for the vertically aligned, depending guideways designated by the numeral 58, whereas the corresponding vertical support member 59 for the guideway structure 54 is secured via a horizontal flange to the supporting bottom 18 as by welding. The outermost vertical side of flange 52 has fixedly secured therein three shaft members having respective supporting wheels 60 rotatably mounted thereon, as best seen in FIGS. 4 and 6. The supporting wheels 60 are vertically configured in a triangular arrangement with a single wheel being received by the upper guideway while the lower guideway receives a pair of such wheels. From the foregoing then, it is apparent that the pushing arm 68 is carried by the supporting wheels 60 to allow front-to-back sliding movement within the drawer 12 with the front facing article engaging surface 50 likewise movable substantially throughout the entire longitudinal length of the cartridge means 22 and maintained in alignment therewithin by virtue of the support wheels 60 being restrained within their respective guideways 58. A spiral spring 62 is freely suspended and contained within an enclosure formed by the forward portions of the guideway structures 54 and 56 and the respective retaining plates 64, the outer end of said spring extending rearwardly through a slot within each said retaining plate and appropriately secured to a hooklike member 66 depending from the flange portion of the pushing arm 48. The spring 62 functions to bias the pushing arm 48 forwardly toward the front of the drawer 12 thus loading the plurality of articles contained within the cartridge means 22 to the front thereon for successive dispensing of the same.

In order to dislodge and dispense articles from the cartridge means 22, an article engaging element 68 is provided adjacent the previously mentioned opposed lateral openings of the forward portion of the cartridge means. As viewed in FIG. 3, the engaging element 68, made from rubber, plastic or the like is rectangularly shaped with one corner thereof adjacent the article to be dispensed, diagonally truncated to allow engagement of a greater surface area of an article when said element is swung from its standby to its operative position in order to dispense the article. A dust shroud 65 partially encloses the engaging element 68, the latter being rigidly secured to a swing arm 70 apertured to receive screw 72 therethrough for swingably mounting arm 70 on mounting tab 74 which in turn is rigidly secured to the drawer 12. A rod-like element 76, part of swing arm 70, pivots about screw 72, such that axial rotation of said rod element likewise rotates the swing arm 70 to swing the article engaging element 68 in a plane generally perpendicular to the longitudinal axes of the cartridge means 22. The rod-like element 76, here shown in FIG. 6 as having an "L" like cross-section may be of any suitable cross-section to achieve the necessary torsional rigidity and extends rearward, essentially parallel to the cartridge means 22, terminating adjacent the rear wall 16 of the drawer 12. It should be observed here that one salient feature of the invention is the absence of fixed structural connection between the means to displace articles (including the engaging element 68, swing arm 70, rod element 76, etc.) and cartridge means 22. It is therefore manifest that since such displacing means are not integral to the cartridge means 22, the latter are structurally simple and may be easily handled for loading purposes.

A link arm 78 having an elongated slot formed therein has the lower end thereof rigidly joined to the rear extending end of rod element 76 and projects vertically, perpendicular from the latter. A pivot pin 80, rigidly secured to the rear wall 16 and horizontally projecting toward the front of the drawer, is sleeved through an aperture in the lowe end of link arm 78 to rotatably mount the latter. A power drive assembly, generally indicated by the numberal 82 in FIG. 7, includes a circular disc-like member 84 which possesses a cam-like notch on the periphery thereof. A straight spring 86, suitably secured to the rear wall 16 is loaded onto the periphery of the disc member 84, the tip of said spring engaging the notch in the disc member in a locking fashion such that the disc member is allowed to rotate in only one angular direction, said spring further tending to maintain the position of the disc member in a single position until the latter is acted upon by a torquing force sufficient in magnitude to overcome the action of the spring, as during a dispensing sequence. A drive plate 88 is securely mounted on the forward side of the disc member 84 and is irregularly elongated in a direction essentially parallel to the rear wall 16, to form an outer node on one side thereof. A drive pin 90 is secured to the outer node of the drive plate 88 and projects forwardly therefrom a suitable distance to pass through the slot portion of link arm 78. The disc-like member 84 includes a rearward projecting shaft which extends through the bearing tube 92, the latter being rigidly secured to the rear wall 16, and a cam-like drive element 94 (best seen in FIG. 8) is appropriately secured to the end of said shaft.

The drive element 94 is suitably adapted to cooperatively engage with power driving means within the dispensing machine when the drawer 12 is inserted in the latter. During the dispensing of an article, the drive element 94 is driven in the clockwise direction as viewed in FIG. 8, thus rotating the entire power drive assembly 82. This rotary motion is then translated by means of drive pin 90 and the slotted link arm 78 into reciprocating motion of the latter, said link arm swinging in a clockwise direction about pivot pin 80 from its normal position of rest shown in FIG. 6, to its maximum clockwise displacement upon one-half of a revolution by the power drive assembly 82, said link arm counterswinging back to its position of rest upon the completion of the revolution by said drive assembly. Since link arm 78 is connected to swing arm 70 via the rod element 76, it is readily apparent that the article engaging element near the front of drawer 12 is synchronously swung from its standby position to its operative position upon revolution of the drive element 94 by a remote motor driving means external of the dispensing drawer 12.

It should be noted here that although the embodiment of the invention described above provides independent dispensing of two different pluralities of articles contained within the respective separate cartridge means disclosed herein, both of said cartridge means may be loaded with the same article and may be alternatively actuated to allow stocking of a double quantity of the same article within a single drawer. Such double stocking of a single article is simply accomplished by gearing each of the power drive assemblies 82 associated with the respective cartridge means, to a single driving gear which is then driven by the remote motor drive, the gear arrangement being such that successive revolutions of the driving gear produce a full revolution in each of the power drive assemblies alternately. Consequently, successive revolutions of the drive gear will result in dispensing of the same article alternately from both cartridge means. It is appropriate to further point out that although a pair of cartridge means have been employed in the disclosed embodiment, a single such cartridge means or a plurality thereof could obviously be mounted in a single dispensing drawer utilizing the novel concepts disclosed herein.

It will be observed that the improved apparatus not only provides for the reliable accomplishment of the object of the invention, but does so in a relatively simple and economical manner. It is recognized, of course, that those skilled in the art may make various modifications or additions to the preferred embodiment chosen to illustrate the invention without departing from the gist and essence of our contribution to the art. Accordingly, it is to be understood that the protection sought and to be afforded hereby should be deemed to extend to the subject matter claimed and all equivalents thereof fairly within the scope of the invention.

We claim:

1. In an article dispensing machine:

drawer means adapted to be received in said dispensing machine;

cartridge means adapted to receive in an aligned successively abutting arrangement a plurality of articles to be dispensed, said cartridge means including means for urging said articles therewithin toward one extremity thereof, said cartridge means being provided with a pair of opposed lateral openings in upright sidewalls thereof and adjacent said one extremity thereof;

releasable means for removably securing said cartridge means upon said drawer means;

article displacing means including an article engaging element mounted on said drawer means for swinging movement from a standby position in which said element is disposed adjacent one of said lateral openings externally of said cartridge means to an operated position in which said element enters said cartridge means through said one lateral opening to engage one of said plurality of articles positioned between said opposed lateral openings and displace said article from said cartridge means through the other of said lateral openings for dispensing thereof.

2. The invention of claim 1, wherein:

said drawer means is provided with means adapting the same to be removably mounted within a dispensing machine and includes a horizontally elongated supporting surface adapted for removably supporting a pair of said cartridge means thereon.

3. The invention of claim 1, wherein:

said cartridge means is elongated and has an opening adjacent the other extremity thereof to receive said plurality of articles therethrough during loading of said articles into said cartridge means.

4. The invention of claim 3, wherein:

said cartridge means includes a transparent element adjacent said one extremity to allow viewing from the front of said machine of the next to be dispensed of said plurality of articles contained therein prior to the dispensing thereof, said cartridge means further including a retaining means adjacent the other of said pair of lateral openings for retaining said plurality of articles within said cartridge means except on those occasions when one of said articles is being dispensed by said article displacing means.

5. The invention of claim 3, wherein:

said cartridge means has a slot therein extending longitudinally substantially the entire length of one side thereof, and said means for urging articles toward one extremity of said cartridge means includes an article pushing element disposed within said cartridge means for contacting a last one of said plurality of articles most distant from said one extremity, said pushing element extending through said slot and being mounted for sliding movement on said drawer means along substantially the entire length of said cartridge means, and extendible biasing means secured to said drawer means and said pushing element and operable to bias the latter into contact with said last one article and urge said plurality of articles toward said one extremity of said cartridge means.

6. The invention of claim 3, wherein:

said article displacing means further includes link means extending essentially the entire length of said cartridge means, one end of said link means being connected to said article engaging element and the opposite end of same being movably secured to said drawer means and adapted to be operably coupled with power means forming a part of said machine for actuating said article engaging element.

7. The invention of claim 6, wherein:

said drawer means includes a vertically projecting wall adjacent said opposite end of said link means, and said link means comprises a rod-like element extending essentially the entire length of said cartridge means and having one end thereof secured to said article engaging element at the swing axis of the latter, the opposite end of said rod-like element being mounted for rotation on said drawer means, a slotted arm having one end thereof connected to said opposite end of said rod, and a rotatable disc element mounted in said wall of said drawer means and having a crank pin secured a spaced distance from the axial center thereof cooperatively engaging with said slotted arm, said disc element being disposed at the rear of said drawer means and adapted to be operably coupled with said power means, said disc element being rotatable in response to actuation of said power means to swing said slotted arm, said rod-like element and said engaging element to dispense one of said plurality of articles.

8. The invention of claim 1, wherein:

said releasable means includes slot means in said drawer means, a detent element secured to said cartridge means proximal to said slot means, and biasing means secured to said drawer means said baising means being operative to engage said cartridge means and urge said detent element in one direction for locking engagement with said slot means to secure said cartridge means on said drawer means, said biasing means being yieldable to allow disengagement of said detent element from said slot means for releasing said cartridge means from said drawer means to allow removal of said cartridge means from the latter.

* * * * *